US007921667B2

(12) United States Patent
Gradl et al.

(10) Patent No.: US 7,921,667 B2
(45) Date of Patent: Apr. 12, 2011

(54) REFRIGERATOR AND/OR FREEZER COMPRISING AN ICE-CUBE MAKER

(75) Inventors: Manfred Gradl, Oberdrauburg (AT); Bernd Fuetsch, Lienz (AT); Roland Schelodetz, Virgen (AT)

(73) Assignee: Liebherr-Hausgeraete Lienz GmbH, Lienz (AT)

( * ) Notice: Subject to any disclaimer, the term of this patent is extended or adjusted under 35 U.S.C. 154(b) by 1001 days.

(21) Appl. No.: 11/351,170

(22) Filed: Feb. 9, 2006

(65) Prior Publication Data

US 2006/0230777 A1 Oct. 19, 2006

(30) Foreign Application Priority Data

Feb. 9, 2005 (DE) ..... 20 2005 002 060 U

(51) Int. Cl.
*F25C 1/22* (2006.01)

(52) U.S. Cl. ..... 62/340

(58) Field of Classification Search ..... 62/129, 62/303, 340

See application file for complete search history.

(56) References Cited

U.S. PATENT DOCUMENTS

| | | | | |
|---|---|---|---|---|
| 4,456,166 | A * | 6/1984 | Kagohata | 236/13 |
| 4,628,699 | A * | 12/1986 | Mawby et al. | 62/137 |
| 5,901,561 | A * | 5/1999 | Allison et al. | 62/126 |
| 6,044,658 | A * | 4/2000 | Ryu | 62/353 |
| 6,092,374 | A * | 7/2000 | Kang et al. | 62/74 |
| 6,613,236 | B1 * | 9/2003 | Guess et al. | 210/739 |
| 7,281,386 | B2 * | 10/2007 | McDougal et al. | 62/74 |
| 2002/0029575 | A1 * | 3/2002 | Okamoto | 62/125 |
| 2005/0268623 | A1 * | 12/2005 | Urakubo et al. | 62/78 |
| 2006/0277568 | A1 * | 12/2006 | Kim et al. | 725/34 |

FOREIGN PATENT DOCUMENTS

| | | | |
|---|---|---|---|
| DE | 43 38 151 | A1 | 3/1994 |
| JP | 04320776 | A | 11/1992 |
| JP | 2002 340454 | A | 11/2002 |
| JP | 2006329571 | A * | 12/2006 |

* cited by examiner

*Primary Examiner* — Melvin Jones
(74) *Attorney, Agent, or Firm* — Dilworth & Barrese, LLP

(57) ABSTRACT

The present invention relates to a refrigerator and/or freezer comprising an ice-cube maker with an ice-cube tray and with means by which the ice-cube tray can be moved out of its operating position into a cleaning position, wherein the refrigerator and/or freezer has a replication unit by means of which an option relating to the cleaning of the ice-cube tray can be replicated; wherein a selection unit is provided by means of which the replicated option can be selected; and wherein a control is provided by means of which the means of moving the ice-cube tray out of its operating position into a cleaning position are activated after selection of the option.

19 Claims, 1 Drawing Sheet

REFRIGERATOR AND/OR FREEZER COMPRISING AN ICE-CUBE MAKER

BACKGROUND OF THE INVENTION

Figure 1:
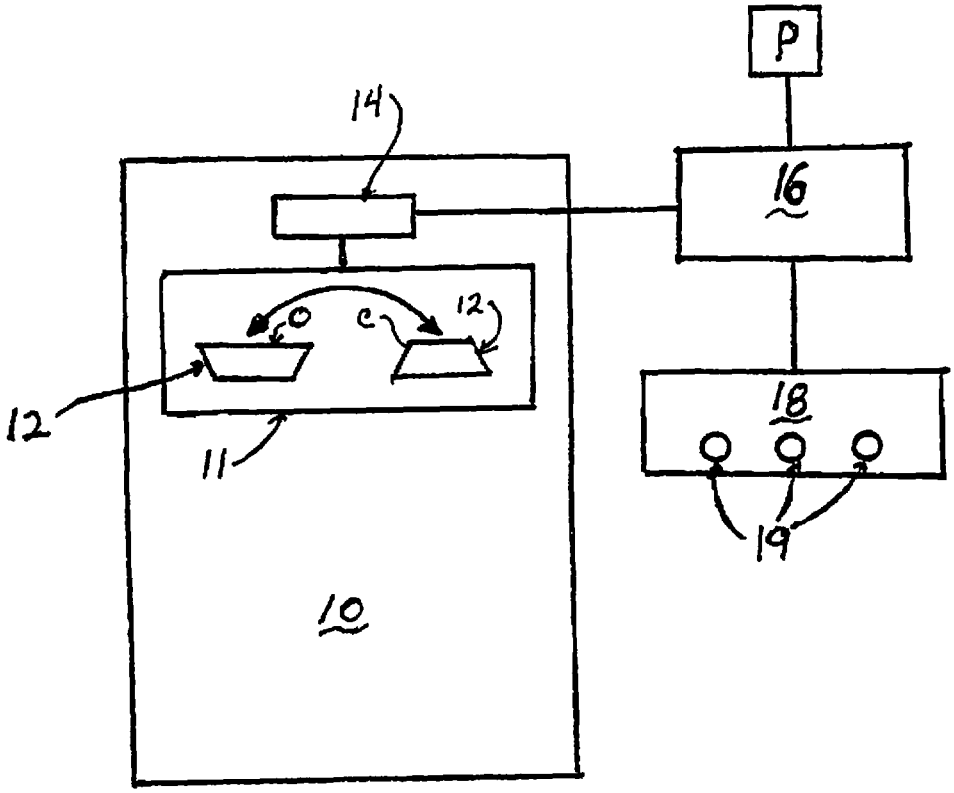

The invention relates to a refrigerator and/or freezer comprising an ice-cube maker with an ice-cube tray and with means by which the ice-cube tray can be moved out of its operating position into a cleaning position.

Refrigerators and/or freezers of this type are already known. The ice-cube tray is typically located in a horizontal position, in which the open side of the ice-cube tray is upwardly located, during the operation of the ice-cube maker. If the ice cubes or residual water should be emptied out or if the ice-cube tray should be cleaned, the ice-cube tray is moved out of its operating position into a cleaning position or an ejection position. In this cleaning position, the ice-cube tray is rotated downwardly by up to 180° with its open side facing down and can now be cleaned after its emptying. To activate the means which move the ice-cube tray out of its operating position into the cleaning position, a button is provided directly at the ice-cube maker which is to be operated several times and over different time intervals or in a predetermined sequence. The operation is thus comparatively complex.

It is therefore the object of the invention to further develop a refrigerator and/or freezer of the initially named kind such that the activation of the means by which the ice-cube tray is moved out of its operating position into the cleaning position is possible simply and in a user-friendly manner.

This object is solved by a refrigerator and/or freezer having the features herein. Provision is accordingly made for the refrigerator and/or freezer to have a replication unit by which the option of cleaning the ice-cube tray can be replicated, for a selection unit to be provided by which the replication option can be selected and for a control to be provided by which the means for moving the ice-cube tray out of its operating position into a cleaning position are activated when this option is selected. Any information is understood under the "option of cleaning the ice-cube tray" which has the cleaning of the ice-cube tray as its object. The text "Clean the ice-cube tray" can, for example, be considered which is shown on a display on the refrigerator and/or freezer. After the selection of this option, the ice-cube tray is moved directly into its cleaning position. Provision can, e.g., be made for this purpose for the ice-cube tray to be rotated and then moved out. It is now available for cleaning after the emptying of residual water and ice-cubes.

The replication unit can be made as a display. The invention is, however, not restricted to a display of this type as the replication means. Any desired replication units can be considered which can be perceived by the user of the appliance, for example also an acoustic replication.

BRIEF DESCRIPTION OF THE DRAWING(S)

FIG. 1 is a diagrammatic illustration of the present invention.

DETAILED DESCRIPTION OF THE INVENTION

A particularly comfortable operation results when a processor is provided which makes available a menu guidance, with the option of cleaning the ice-cube tray being able to be replicated and/or selected within the framework of the menu guidance. Suitable operating elements are to be provided for this purpose which allow the actuation of the menu. It is, for example, conceivable that the menu item "AICM" is selected from the menu, with "AICM" standing for automatic ice-cube maker. The activation of the means for moving the ice-cube tray out of its operating position into its cleaning position can now be selected from the menu item "AICM functions". The control in accordance with the invention thereupon directly effects the corresponding activation of these means without any further action of the user of the refrigerator and/or freezer.

In a further aspect of the invention, further parameters and/or functions of the ice-cube maker and/or of the refrigerator and/or freezer can be replicated by means of the replication unit. The replication of the temperature or also the filling amount of the ice-cube tray is e.g. conceivable.

These further parameters and/or functions of the ice-cube maker and/or of the refrigerator and/or freezer can likewise also be replicated and/or selected within the framework of the menu guidance, with a comparatively simple operation of the refrigerator and/or freezer resulting from this.

The selection unit in accordance with the invention by means of which the replicated option is selected, i.e. confirmed, can be made in the form of one or more buttons. These can be the same buttons by means of which the menu guidance also takes place.

An aspect of the invention is also conceivable in which the selection unit does not have any operating elements, but in which the replicated option is preferably automatically activated after the end of a specific time period or production amount, without any further actions of the user being required.

The form in which the menu guidance is activated and the selection is made can largely be any desired. It is, for example, possible to provide two buttons, with one button serving the "scrolling" of the menu in the one direction and the other button serving the "scrolling" of the menu in the other direction. A selection of the option displayed can, for example, take place in that both buttons are activated simultaneously. It is also conceivable to provide a separate button for confirmation, i.e. for the selection of the replicated option. Generally, any aspects deviating from this are also possible.

In a further aspect of the invention, the replication unit is made as a display and bus-capable display electronics are provided for the control of the display.

The arrangement of the replication unit and of the selection unit is largely as desired. Easily accessible or visible positions on the refrigerator and/or freezer are preferred. It is conceivable that the replication unit and/or the selection unit is arranged on the outside or inside of the door of the refrigerator and/or freezer, on the body of the refrigerator and/or freezer or on the inner container of the refrigerator and/or freezer. An arrangement on the ice-cube maker itself is also conceivable. Provided that a fixed strip connected to the body extends above the door of the refrigerator and/or freezer, provision can be made for the replication unit and/or the selection unit to be arranged in this strip. Provision is preferably made for visual reasons for this strip to be flush with the door when the door of the refrigerator and/or freezer is closed so that a uniform overall impression is created.

The means by which the ice-cube tray can be moved out of its operating position into a cleaning position can be designed such that the ice-cube tray is rotated. Provision can likewise be made for the means by which the ice-cube tray can be moved out of its operating position into a cleaning position to be designed such that the ice-cube tray is first rotated and then moved out.

In this process, a rotation of the ice-cube tray can take place up to 180°, with an angular region between 120° and 150° being preferred. If the rotation of the ice tray is carried out by 180°, the ice-cube tray is upside down after the rotation and the open side faces downwardly.

If the ice-cube tray is fixed in its cleaning position, the user has easy access to the inside of the ice-cube tray, without having to hold it tight during the cleaning.

Subsequently to this, the ice-cube tray can again be moved out of its cleaning position into the operation position. This preferably likewise takes place by means of the said menu control or by selection of a corresponding menu item by the user. It is likewise conceivable that the activation of a button is sufficient to move the ice-cube tray back into its operating position, without a repeated menu selection being required.

Provision is made in a further aspect for means to be provided which emit the indication on the switching off of the appliance that the ice-cube tray is to be moved into its cleaning position or that a cleaning of the ice-cube tray should still take place. An indication of this type effectively prevents the appliance remaining with water in the ice-cube tray for a longer time after being switched off. An indication of this type can take place e.g. acoustically or visually, for example by a readout in the aforesaid display.

The invention further relates to a refrigerator and/or freezer comprising an ice-cube maker with an ice-cube tray and with means by which the ice-cube tray can be moved out of its operating position into a cleaning position, with the refrigerator and/or freezer having an operating element which is in communication with the means such that the actuation of the operating element directly results in the activation of the means and thus in the movement of the ice-cube tray out of its operating position into a cleaning position. In contrast to the embodiment from the prior art described above, the actuation of the operating element directly results in the activation of the said means in this aspect. A multiple actuation or the actuation over predetermined time intervals to activate the means of moving the ice-cube tray is not necessary. The one-time, and accordingly simple, actuation of the operating element is sufficient.

The operating element can be made in the form of one or more buttons.

In a further aspect of the invention, the refrigerator and/or freezer in accordance with this embodiment of the invention is made in accordance with the description herein.

DESCRIPTION OF THE PREFERRED EMBODIMENT

Further details and advantages of the invention will be explained in more detail with respect to an embodiment described in the following.

A refrigerator and/or freezer in the form of a domestic refrigerator, a fridge/freezer combination or of a domestic freezer comprises an automatic ice-cube maker. This comprises an ice-cube tray which stands horizontally and upwardly open in its operating position and in which the ice cubes made are located.

The refrigerator and/or freezer furthermore has an appliance door which closes the cooling space. A display is located on the outside of the appliance door in which specific parameters of the refrigerator and/or freezer can be displayed. The readout shown in the display is generated by a processor, with the parameters and functionalities of the refrigerator and/or freezer being compiled in menus or being accessible by means of a menu guidance. The menu guidance takes place by means of two buttons which are located in the region next to the display. In this process, the one button serves to "scroll" through the menu in one direction and the other button to "scroll" in the other direction. As soon as the desired option is displayed to the user, this can be selected or confirmed by a further button.

The named menu has a menu item "AICM functions". If this item is selected, depending on the design of the appliance, either a sub-menu is opened or, alternatively, the means are activated directly which move the ice-cube tray out of its position of use into the cleaning position. The named sub-menu can, for example, comprise the items "Temperature display" or "Filling amount of the ice-cube tray". A further item is the option "Cleaning the ice-cube tray". If this option is selected, the means are directly activated which turn the ice-cube tray through 180° and then move it out so that the mold, i.e. the open side of the ice-cube tray, faces downwardly. In this process, an emptying of residual water and of still present ice-cubes takes place.

After the rotation, the ice-cube tray is fixed in its ejection position and can now be cleaned on its inside without problem.

Subsequent to this, the ice-cube tray is again moved into its operating position. Provision can be made for this purpose for one or more buttons to be actuated without menu selection, with this being a question of the button(s) by means of which the menu guidance also takes place. It is also conceivable to carry out the moving of the ice-cube tray into its operating position in a corresponding manner to the moving into the cleaning position by means of the menu guidance.

The invention relates to a simple and customer-friendly cleaning option of the ice-cube tray, e.g. to be activated via a display. When the appliance is taken out of operation, the ice-cube tray can be emptied immediately and with a low effort to avoid the formation of bacteria and odor by residual water in the warm freezing compartment.

Provision can furthermore be made for a signal tone or an acoustic or visual indication to be made on the switching off of the appliance, for example before a longer absence, to the effect that the ice-cube tray still has to be emptied or that the means are to be actuated by which the ice-cube tray is moved into its cleaning position.

The term "ice-cube tray" includes any desired vessel for ice production irrespective of its shape or of the form of the ice produced.

With particular reference now to FIG. 1, refrigerator/freezer 10 includes an ice maker 11 having ice tray 12 and control 14 for moving the ice tray 12 between an operating position 0 and a cleaning position C. The refrigerator/freezer 10 includes a replication unit 16 with display, and a selection unit 18 having one or more buttons 19. A processor P is provided for menu guidance.

The invention claimed is:

1. A refrigerator and/or freezer comprising an ice-cube maker with an ice-cube tray and means arranged for moving the ice-cube tray out of its operating position into a cleaning position, wherein the refrigerator and/or freezer has a replication unit by which an option relating to the cleaning of the ice-cube tray can be replicated;

a selection unit is provided by which the replicated option can be selected; and a control by means of which the means arranged for moving the ice-cube tray out of its operating position into a cleaning position arc activated after selection of the option.

2. A refrigerator and/or freezer in accordance with claim 1, wherein the replication unit is made as a display.

3. A refrigerator and/or freezer comprising an ice-cube maker with an ice-cube tray and means arranged for moving the ice-cube tray out of its operating position into a cleaning position, wherein the refrigerator and/or freezer has a replication unit by which an option relating to the cleaning of the ice-cube tray can be replicated;

a selection unit is provided by which the replicated option can be selected; and a control by means of which the means arranged for moving the ice-cube tray out of its operating position into a cleaning position are activated after selection of the option, wherein a processor is provided which makes available a menu guidance; and the option of cleaning the ice-cube tray can be replicated and/or selected within the framework of the menu guidance.

4. A refrigerator and/or freezer in accordance with claim 1, wherein further parameters and/or functions of the ice-cube maker and/or of the refrigerator and/or freezer can be replicated by the replication unit.

5. A refrigerator and/or freezer in accordance with claim 3, wherein the further parameters and/or functions of the ice-cube maker and/or of the refrigerator and/or freezer can likewise be replicated and/or selected within the framework of the menu guidance.

6. A refrigerator and/or freezer in accordance with claim 1, wherein the selection unit is made in the form of one or more buttons.

7. A refrigerator and/or freezer in accordance with claim 1, wherein the replication unit is made as a display and bus-capable display electronics are provided for the control of the display.

8. A refrigerator and/or freezer in accordance with claim 1, wherein the replication unit and/or the selection unit is arranged on the outside or inside of a door of the refrigerator and/or freezer, on a body of the refrigerator and/or freezer, on an inner container of the refrigerator and/or freezer or on the ice-cube maker.

9. A refrigerator and/or freezer in accordance with claim 1, wherein the means by which the ice-cube tray can be moved out of its operating position into a cleaning position are made such that the ice-cube tray is rotated.

10. A refrigerator and/or freezer in accordance with claim 1, wherein the means by which the ice-cube tray can be moved out of its operating position into a cleaning position are made such that the ice-cube tray is first rotated and then moved out.

11. A refrigerator and/or freezer in accordance with claim 9, wherein a rotation of the ice-cube tray takes place by up to 180°.

12. A refrigerator and/or freezer in accordance with claim 1, wherein means are provided by which the ice-cube tray is fixed in its cleaning position.

13. A refrigerator and/or freezer in accordance with claim 1, wherein means are provided which emit an indication relating to the cleaning of the ice-cube tray on the switching off of the refrigerator and/or freezer.

14. A refrigerator and/or freezer in accordance with claim 9, wherein a rotation of the ice-cube tray takes place by 120° to 150°.

15. A refrigerator and/or freezer in accordance with claim 9, wherein a rotation of the ice-cube tray takes place by up to 180°.

16. A refrigerator and/or freezer in accordance with claim 9, wherein a rotation of the ice-cube tray takes place by 120° to 150°.

17. A refrigerator and/or freezer in accordance with claim 1, wherein the refrigerator and/or freezer has an operating element which is in communication with the means such that actuation of the operating clement directly results in the activation of the means and thus in the moving of the ice-cube tray out of its operating position into a cleaning position.

18. A refrigerator and/or freezer in accordance with claim 4, wherein the further parameters and/or functions of the ice-cube maker and/or of the refrigerator and/or freezer can likewise be replicated and/or selected within the framework of the menu guidance.

19. The refrigerator and/or freezer of claim 1 wherein the selection unit provides a menu of options.

* * * * *